US005678245A

United States Patent [19]

Rector et al.

[11] Patent Number: 5,678,245

[45] Date of Patent: Oct. 21, 1997

[54] FLEXIBLE BASEBALL GLOVE WITH GROOVED FOAM PADDING SYSTEM AND POLYURETHANE TUBE LACING AND FASTENERS

[76] Inventors: James L. Rector, 1709 Forest Hills Dr., Vienna, W. Va. 26105; Rodney M. Zide, 7 Painters Crossing; Robert M. Zide, 300 W. Fourth St., both of Williamstown, W. Va. 26187

[21] Appl. No.: 591,095

[22] Filed: Jan. 25, 1996

[51] Int. Cl.[6] ..... A41D 13/10

[52] U.S. Cl. ..... 2/19

[58] Field of Search ..... 2/19, 161.1, 167, 2/168; 273/25, 26 C

[56] References Cited

U.S. PATENT DOCUMENTS

| | | | |
|---|---|---|---|
| 547,424 | 10/1895 | Eaton . | |
| 967,120 | 8/1910 | Gamble . | |
| 1,881,038 | 10/1932 | Whitehouse . | |
| 1,916,733 | 7/1933 | Light . | |
| 1,963,318 | 6/1934 | Wolf | 5/347 |
| 1,980,758 | 11/1934 | Komorous | 40/10 |
| 3,066,370 | 12/1962 | Epstein | 24/117 |
| 4,214,505 | 7/1980 | Aimar | 85/55 |
| 4,344,240 | 8/1982 | Schiller | 40/20 R |
| 4,411,024 | 10/1983 | Hayes | 2/20 |
| 4,592,579 | 6/1986 | Burnett | 292/327 |
| 4,663,783 | 5/1987 | Obayashi | 2/161 A |
| 4,677,698 | 7/1987 | Angas | 2/161 A |
| 5,023,982 | 6/1991 | Mehan | 24/215.3 |
| 5,111,558 | 5/1992 | Ridley et al. | 24/215.3 |
| 5,119,539 | 6/1992 | Curry | 24/712.1 |
| 5,161,285 | 11/1992 | Jerjian | 24/113 R |
| 5,285,529 | 2/1994 | Arena | 2/19 |
| 5,379,459 | 1/1995 | Williams, Jr. | 2/19 |
| 5,448,775 | 9/1995 | Yanada et al. | 2/19 |
| 5,448,776 | 9/1995 | Caruso | 2/19 |

*Primary Examiner*—C. D. Crowder
*Assistant Examiner*—Larry O. Worrell, Jr.
*Attorney, Agent, or Firm*—Birch, Stewart, Kolasch & Birch, LLP

[57] ABSTRACT

A baseball glove having a laminate foam rubber padding with low rebound and energy damping properties, is constructed and arranged to provide stiffness in the longitudinal axial direction of the thumb and forefinger portion of the glove and the little finger portion of the glove but a flexibility in a transverse axial direction across the palm of the hand in a direction toward the little finger portion of the glove, to thereby preclude the "breaking-in" period customarily required for a new glove. The glove laces are made of hollow plastic tubing having elastic memory. The tubular end portions of the lacings are secured to the leather covering by fasteners having planar surfaces carrying advertising indicia.

12 Claims, 8 Drawing Sheets

FLEXIBLE BASEBALL GLOVE WITH GROOVED FOAM PADDING SYSTEM AND POLYURETHANE TUBE LACING AND FASTENERS

BACKGROUND OF THE INVENTION

Heretofore baseball gloves have employed felt pad systems in the thumb, heel and little finger portions of the glove. The felt pad system is contained within a cover having front and back leather portions which are held together by leather lacing extending through the leather portions.

Certain disadvantages have been experienced with these prior art gloves in that the felt pad system is very stiff and hard to flex, requiring a long breaking-in time to get the glove into playing shape. After the glove has been broken-in it loses its shape if laid down for a period of time; for instance, from the end of one baseball season to the beginning of the next. The loss of shape is an inherent characteristic of felt since it moves or settles. Current ball glove manufacturers employ a plastic insert in the thumb and finger areas to hold the felt pad in place; however, this adds to the stiff feel of the glove.

Another disadvantage experienced with prior art baseball gloves is that the leather lacing stretches and breaks. When the lacing stretches, the glove loses its shape resulting in the pocket, webbing and fingers becoming distorted, making the glove hard to control and handle when fielding and in catching a ball.

After considerable research and experimentation the flexible baseball glove of the present invention has been devised to overcome the disadvantages experienced with the prior art gloves and includes a grooved foam padding system, in lieu of the felt pad system, to thereby give the glove a broken-in feel when the glove is put on the first time, and which will not lose its shape in between baseball seasons. Polyurethane tubing is employed for the lacing rather than leather, since the tubing has an elastic memory so that there is no stretching or change in the pocket, webbing and fingers, whereby the shape of the glove will remain intact during repeated use, and advertizing indicia carrying fasteners are provided at the knotted end portions of the lacing to preclude the necessity of stitching or burning the manufacturer's logo onto the leather covering of the glove.

SUMMARY OF THE INVENTION

The baseball glove of the present invention comprises, essentially, a laminate foam rubber padding including layers of foam rubber having a density to provide low rebound of a ball being caught in the glove. The padding is constructed and arranged to provide stiffness in the longitudinal axial direction of the thumb and forefinger and little finger, but flexibility in a transverse axial direction across the palm of the hand where the base of the thumb bends in a direction toward the little finger, whereby a "breaking-in" period is avoided. The glove laces comprise polyurethane tubing, the terminal ends of which are secured to the leather portions of the glove by suitable fasteners having planar surfaces upon which advertizing indicia is placed in lieu of the conventional stitching of a label or the burning of logo onto the glove.

DESCRIPTION OF THE PREFERRED EMBODIMENTS

Figure 1:
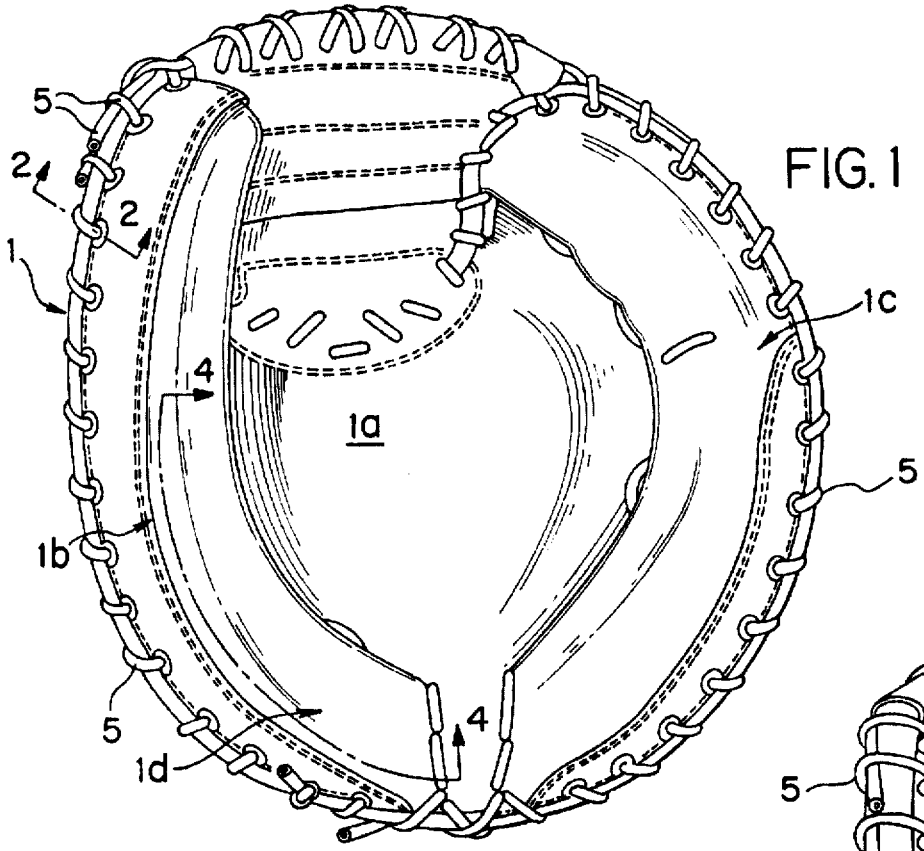
FIG. 1 is a front elevational view of a catcher's mitt employing the foam padding system and tubular lacing of the present invention.
Figure 2:
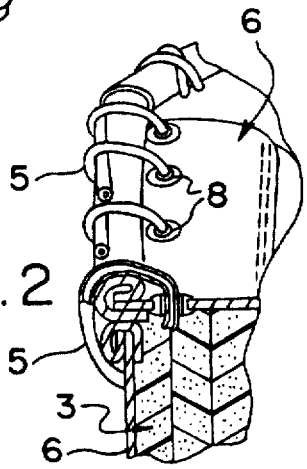
FIG. 2 is a view taken along line 2—2 of FIG. 1.
Figure 3:
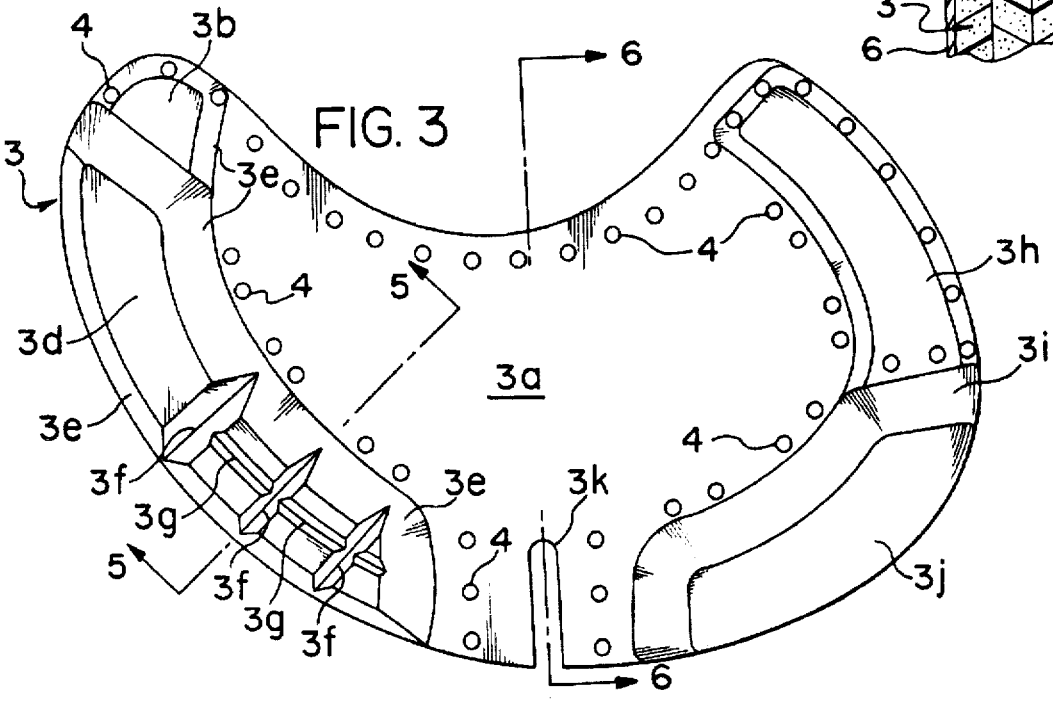
FIG. 3 is a front elevational view of the foam padding system of the present invention employed in the mitt illustrated in FIG. 1.
Figure 4:
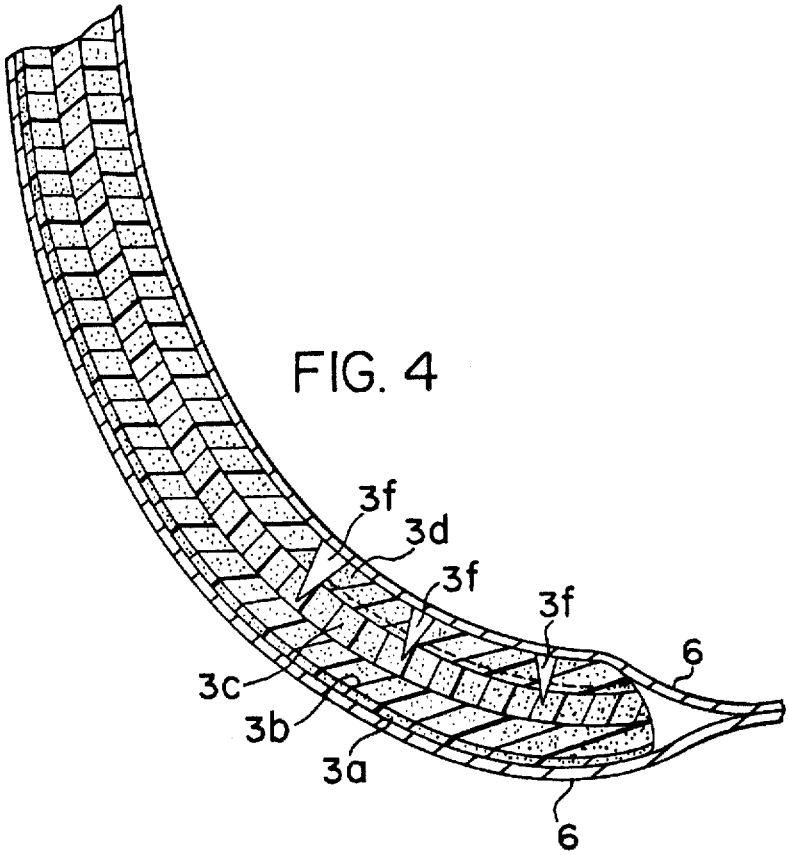
FIG. 4 is a view taken along line 4—4 of FIG. 1.
Figure 5:
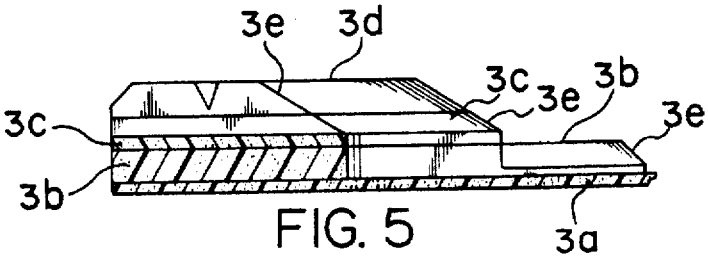
FIG. 5 is a view taken along line 5—5 of FIG. 3.
Figure 6:
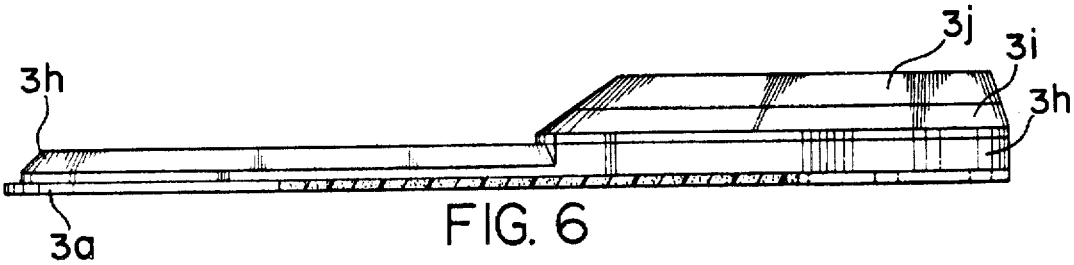
FIG. 6 is a view taken along line 6—6 of FIG. 3.
Figure 7:
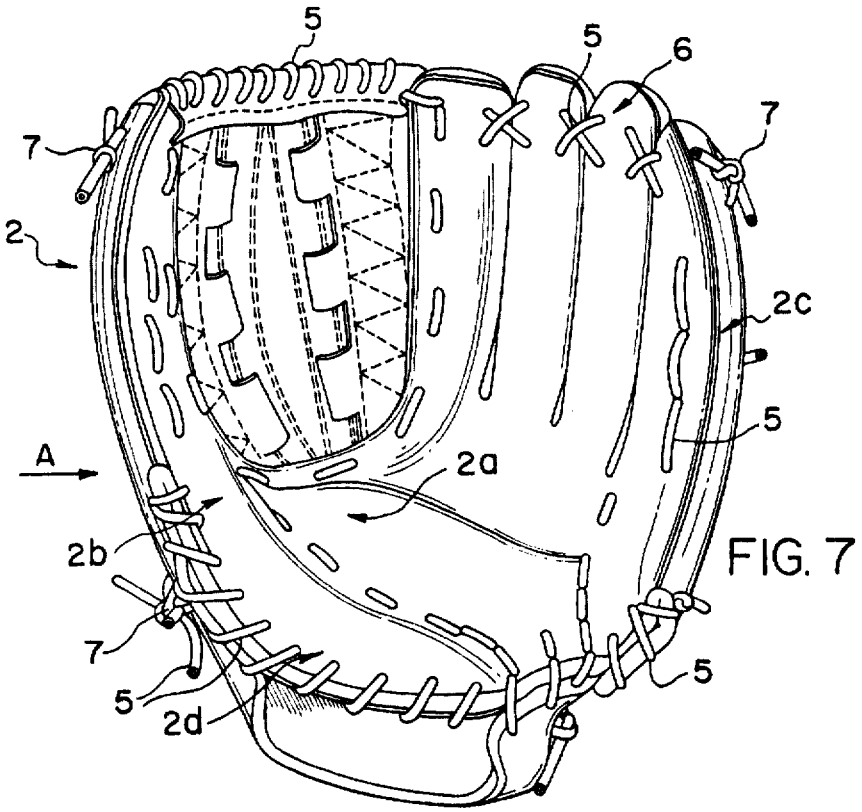
FIG. 7 is a perspective view of a fielder's glove.

Referring to the drawings, and more particularly to FIGS. 1 and 7, there is illustrated a catcher's mitt 1 and a fielder's glove 2, respectively, each of which includes a pocket portion 1*a*, 2*a* extending between the thumb and forefinger portion 1*b* and 2*b* and the little finger portion 1*c* and 2*c*, and a heel portion 1*d*, 2*d* in proximity to the base of the thumb portion 1*b*, 2*b*. In catching baseballs, the ball preferably impacts in the pocket portion 1*a*, 2*a*, and the player immediately attempts to close the glove by pivoting the thumb portion 1*b*, 2*b* toward the little finger portion 1*c*, 2*c* by pivoting the base of the player's thumb near the heel of the hand, while keeping the fingers straight. Because the ball sometimes impacts near the end of the thumb or finger, pad protection with stiffness along the longitudinal axial direction is needed to resist the bending of the thumb or finger backwards. Conventional ball gloves are also relatively stiff in a transverse axial direction between the thumb portion 1b, 2b and little finger portion 1c, 2c, requiring a "breaking-in" period to soften and distort the padding along this transverse axis to improve flexibility, to thereby facilitate the pivoting of the thumb portion 1b, 2b toward the little finger portion 1c, 2c.

To preclude the necessity of a "breaking-in" period, the pad 3, shown in FIGS. 3 to 6, has been devised for the catcher's mitt 1, and comprises a laminate foam rubber structure including a base layer 3a configured to the profile of the mitt 1, and superimposed arcuate layers 3b, 3c and 3d having bevelled peripheral edges 3e positioned in the thumb portion 1b of the mitt. The upper layers 3c and 3d are provided with transversely extending grooves 3f, and the top layer 3d is provided with a longitudinal groove 3g extending between the transverse grooves 3f. Similarly, the little finger portion 1c is provided with foam rubber arcuate layers 3h, 3i, 3j superimposed on the base layer 3a. All of the various foam layers are laminated together by glue or adhesive. The portion of the pad for the little finger is spaced transversely from the pad portion for the thumb and a slot 3k is provided in the back layer 3a between the thumb and little finger pad portions to facilitate the pivoting of the thumb portion 1b toward the little finger portion 1c when catching a ball. The flexibility of the thumb portion is also enhanced by the grooves 3f and 3g which are V-shaped at angles in the range of 15°–45° and preferably of approximately 15°. The V-grooves in the foam padding function as hinges along their respective axes to provide the glove a broken-in feel when the glove is put on and used for the first time, and cause the padding to curve when laced in the glove, to match the curvature of the glove, and enable it to be flexed by the user and by the force of a ball making contact with the pocket so that the padding flexes around toward the pocket along substantially longitudinal and lateral axes to trap the ball in the pocket. The V-grooves allow the pocket to be formed thumb to little finger, i.e. U-shape, or little finger to lower part of the thumb, i.e. L-shape, without any break-in required. The foam padding thus tends to wrap around and conform to the ball, thereby reducing the tendency of ball rebound during a catch. Generally, more smaller angle V-grooves 3f are preferred, such as three, shown in FIGS. 3 and 4, or more, having an angle of approximately 15° each, as a greater number of small angle grooves eliminate wrinkling of the leather cover while retaining the improved flexibility of the pads. To provide stiffness to the thumb and little finger portions along the longitudinal axial direction, the layer 3a of foam rubber is preferably of a higher density than the remaining layers 3b, 3c, 3d, 3h, 3i and 3j in the laminate structure which are comprised of a high density foam having low rebound and energy damping properties. The foam padding, unlike prior padding systems, such as felt, will not shift in the glove and will not lose its shape when not being used from the end of one season to the start of the next season.

A plurality of apertures 4 are provided in the pad 3 through which a tubular lacing 5 extends to secure the pad within the leather coverings 6, the terminal end portions of the lacing being tied in knots 7, as shown in FIG. 7. The tubing is made of plastic material having an elastic memory, such as polyurethane tubing having a ⅛ inch outside diameter and a 1/16 inch inside diameter and 83A durometer. Different durometer urethane may be used, but 83A durometer has been found to have better knotting capability than harder material and better elastic memory than softer material for this application. Polyurethane tubular lacing holds knots when laced better than solid lacing material and reduces the tendency of the ball to rebound from the glove, and provides enough stretch to compensate for expected shrinkage of the leather covering 6. The tubular configuration of the lacing 5 facilitates the sliding of the lacing through the holes 4 in the pad 3 and the eyelets 8 in the leather coverings 6; also, the slippage of the lacing 5 through the holes 4 and eyelets 8 equalizes the holding force through the length of the lacing 5. Furthermore, the tubular lacing 6 when being tied in the knot 7 becomes crushed to provide a more improved holding than provided by conventional leather laces. The advantage of polyurethane tubular lacing over leather lacing is contribution to flexibility, softness for resisting ball rebound, particularly while wet, and excellent wear resistance and durability under a wide range of conditions.

Figure 8:
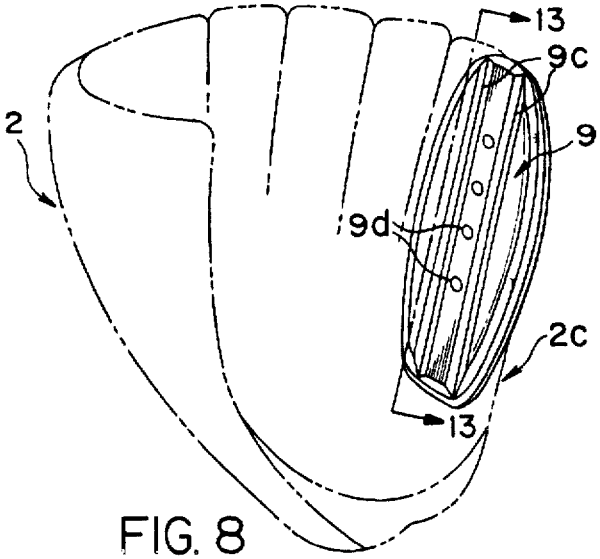
FIG. 8 is a perspective view of the foam padding system of the present invention employed in the little finger portion of the glove illustrated in FIG. 7.
Figure 9:
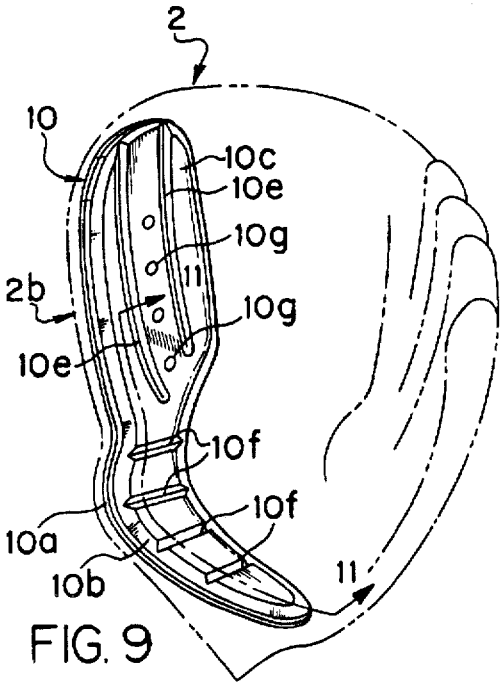
FIG. 9 is a perspective view of the foam padding system employed in the thumb portion of the glove shown in FIG. 7.
Figure 10:
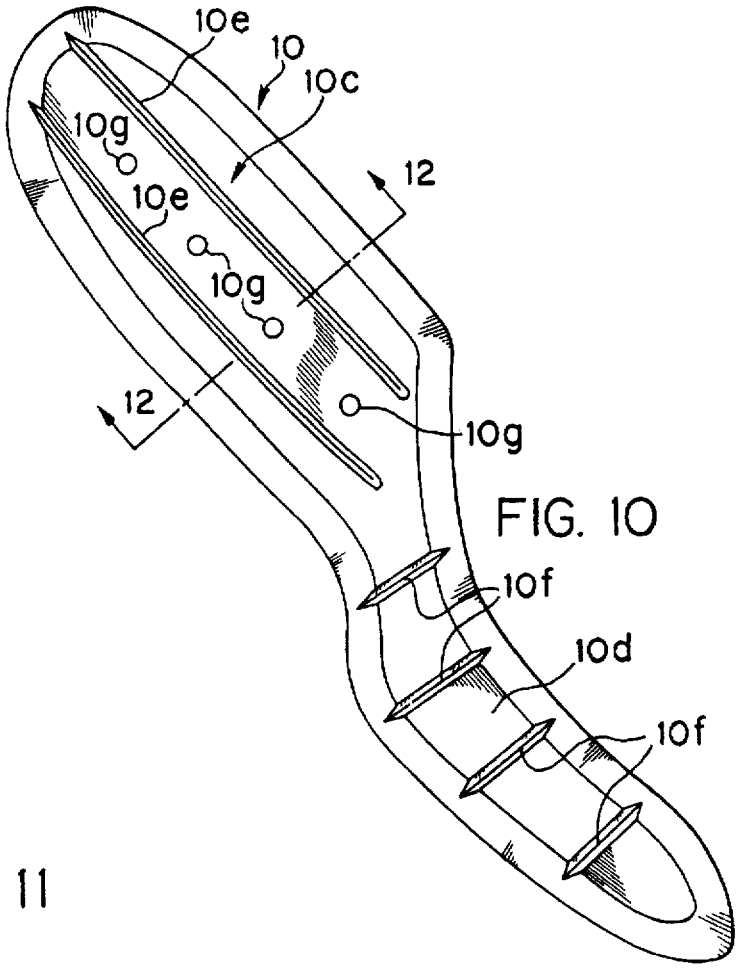
FIG. 10 is a top plan view, on an enlarged scale, of the foam padding shown in FIG. 9 but illustrated in a flattened position.
Figure 11:
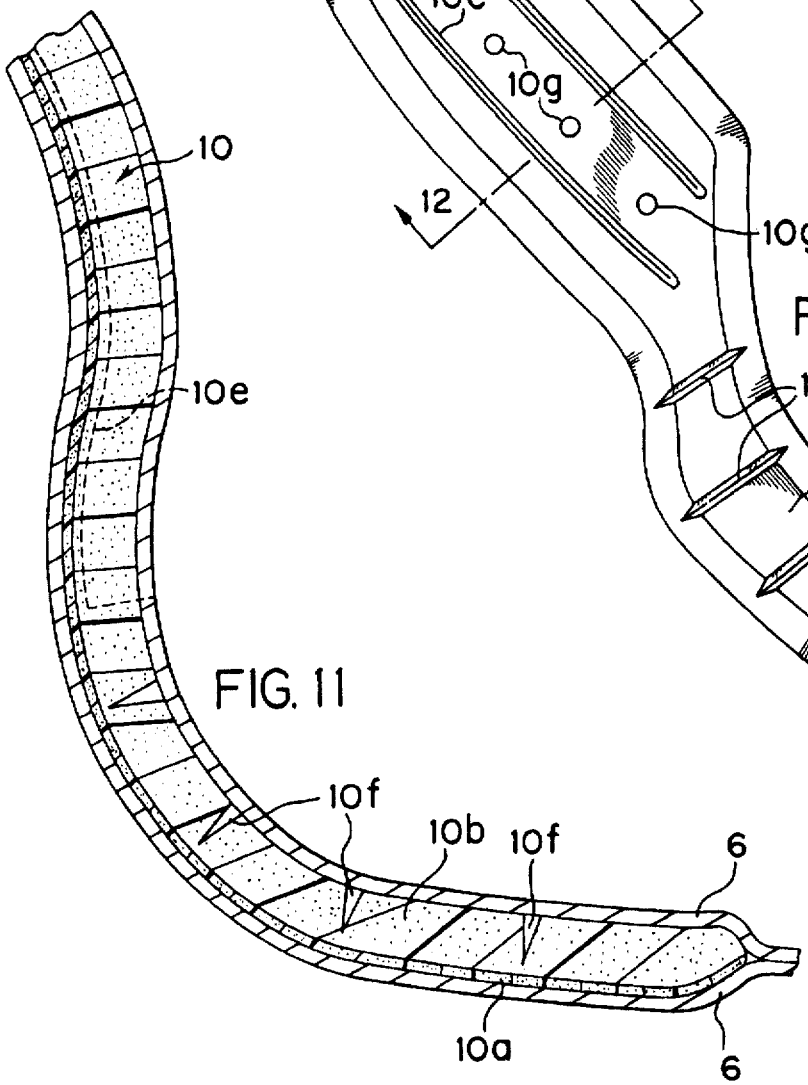
FIG. 11 is an enlarged longitudinal sectional view taken along line 11—11 of FIG. 9.
Figure 12:
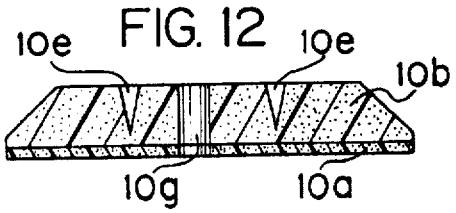
FIG. 12 is a view taken along line 12—12 of FIG. 10.

FIGS. 8 and 9 illustrate the pads 9 and 10 employed in the little finger portion 2c and the thumb portion 2b, respectively, of the fielder's glove 2, shown in FIG. 7. As will be seen in FIGS. 10 to 12, the pad 10 comprises a foam rubber laminate structure having a base layer 10a and superimposed layer 10b. The pad 10 is configured to have a thumb and forefinger portion 10c. The base layer 10a has a higher density than the layer 10b to provide stiffness to the thumb and forefinger portion 2b of the glove 2 in a longitudinal axial direction, and longitudinal grooves 10e are provided in the portion 10c and transverse grooves 10f in the portion 10d to facilitate the pivoting of the thumb and forefinger portion 2b of the glove 2 toward the little finger portion 2c when catching a ball. The layer 10b is preferably a high density foam having low rebound and energy damping properties. A plurality of spaced axially extending apertures 10g are provided in the thumb and forefinger portion 10c of the pad through which the lacing 5 extends.

Figure 13:
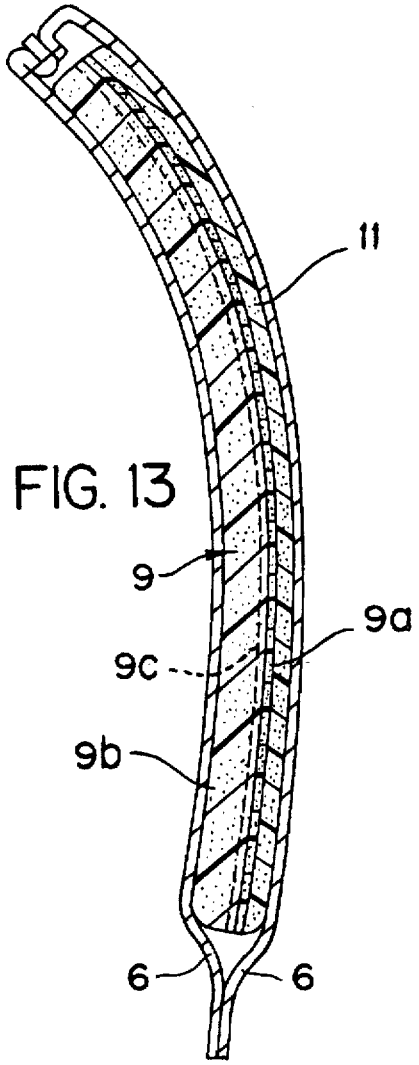
FIG. 13 is an enlarged longitudinal sectional view taken substantially along line 13—13 of FIG. 8.

The pad 9 for the little finger portion 2c of the glove is similar to the thumb and forefinger portion 10c of pad 10, and, as shown in FIGS. 8 and 13, comprises a base layer 9a of foam rubber having a higher density than that of superimposed layer 9b. The layer 9b is provided with longitudinal grooves 9c and a plurality of lacing apertures 9d extend through the pad.

Figure 14:
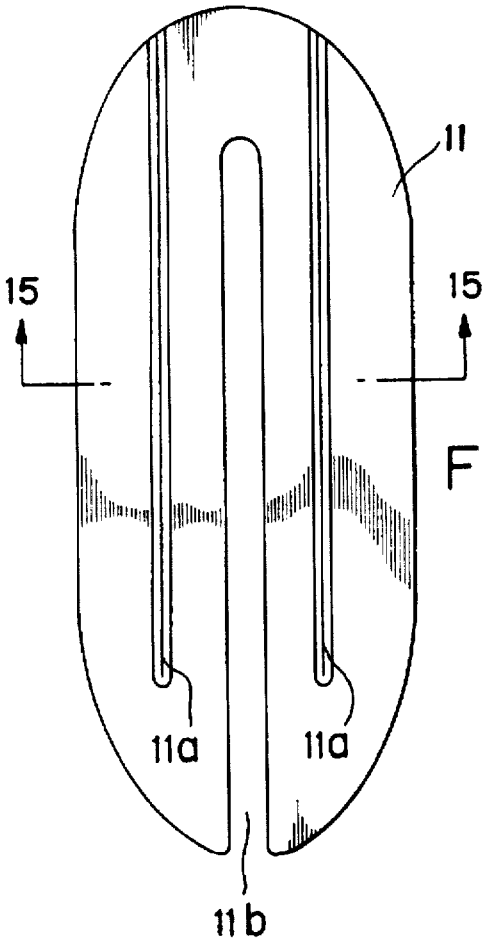
FIG. 14 is a plan view of a stiffener employed with the padding of FIG. 8.
Figure 15:
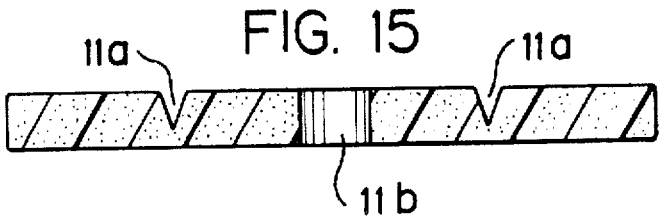
FIG. 15 is an enlarged cross-sectional view taken along line 15—15 of FIG. 14.

As shown in FIGS. 13 to 15, a further stiffening member 11 of more dense plastic material can be provided against the base layer 9a opposite to the face against which the layer 9b engages. The stiffening member 11 has an elliptical configuration and a pair of spaced, parallel, longitudinally extending grooves 11a, facing toward layer 9a, and a longitudinally extending slot 11b positioned in the space between the grooves 11a and registered with the plurality of apertures 9d through which the tubular lacing 5 extends.

A similar stiffening member 11 may be used, if desired or needed, beneath base layer 10a in the thumb and forefinger portion 10c of pad 10. The stiffening member 11 stiffens the laminated pads 10 and/or 9 along the longitudinal axes of the thumb or fingers, or across the tip of the glove, while the grooves 11a and slot 11b limit the stiffness of this member in the lateral or transverse direction, so the member 11 and associated padding and glove can bend or curve laterally. Thus, the grooves and slot limit stiffness from the stiffening member 11 generally to a single direction.

Figure 16:
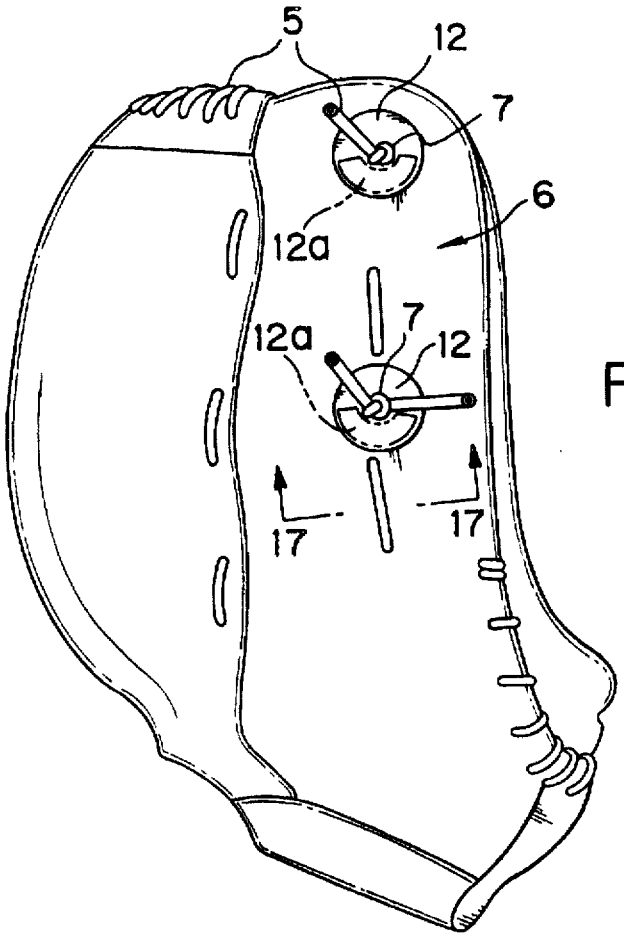
FIG. 16 is a side elevational view of the glove as viewed along the direction of arrow A in FIG. 7, illustrating the tubular lacing and one embodiment of a fastener for securing the terminal end of the tubular lacing to the glove.
Figure 17:
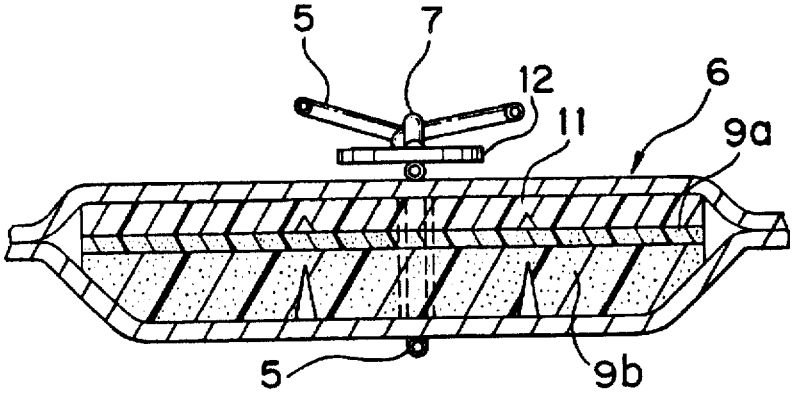
FIG. 17 is an enlarged cross-section view taken substantially along line 17—17 of FIG. 16.
Figure 18:
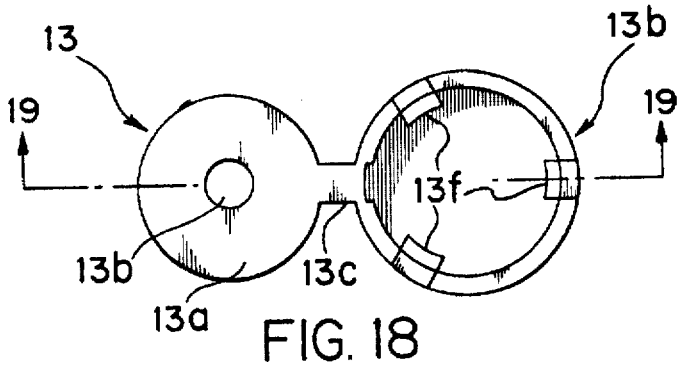
FIG. 18 is a bottom plan view of another embodiment of a fastener for the tubular lacing.
Figure 19:
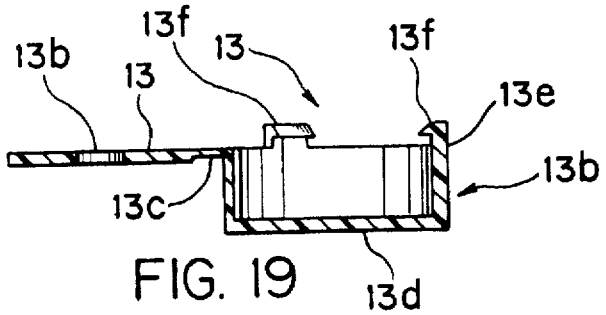
FIG. 19 is a view taken along line 19—19 of FIG. 18.
Figure 20:
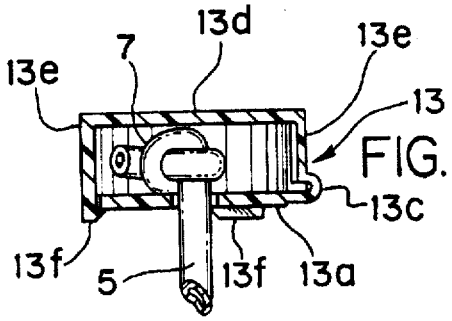
FIG. 20 is a cross-sectional view illustrating the fastener of FIGS. 18 and 19 secured in a closed position to the end of the tubular lacing.
Figure 21:
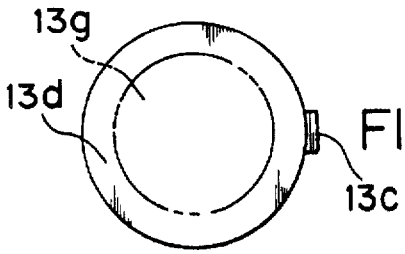
FIG. 21 is a top plan view of the fastener shown in FIG. 20.

Referring to FIGS. 16 and 17, a disc 12 having an aperture or apertures therein through which lacing 5 extends, is provided at the knotted end 7 of the tubular lacing 5 and advertising indicia 12*a*, such as the logo of the manufacturer of the glove, is provided on the face of the disc. By this construction and arrangement, a separate label carrying the manufacturer's logo need not be stitched onto the glove as is done on conventional gloves. The disc 12 is preferably constructed of stiff or semi-rigid plastic material and prevents the knot 7 from pulling through the leather covering 6.

FIGS. 18 to 21 illustrate another embodiment of an integrally molded plastic fastener 13 for the knotted end 7 of the tubular lacing 5, which comprises a disc 13*a* having a central aperture 13*b* through which the tubular lacing 5 extends, similar to disc 12, and knotted as at 7. A cylindrical cap closure 13*b* is hingedly connected as at 13*c* to the disc 13*a*, and comprises a top wall portion 13*d* having an integral depending side skirt portion 13*e*. A plurality of inwardly extending, circumferentially spaced, fingers 13*f* are molded integral with the lower peripheral edge of the skirt portion 13*e*, adapted to snap under the peripheral edge of the disc 13*a*. The manufacturer's logo 13*g* is imprinted in the illustrated dot-dash line area on the upper surface of the closure top wall portion 13*d*.

Figure 22:
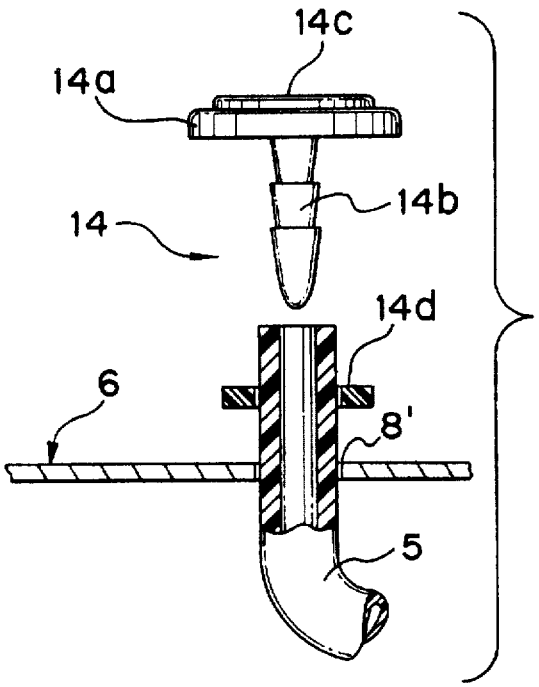
FIG. 22 is an exploded side elevational view, partly in section, of still another embodiment of a fastener for securing the tubular lacing to the glove.
Figure 23:
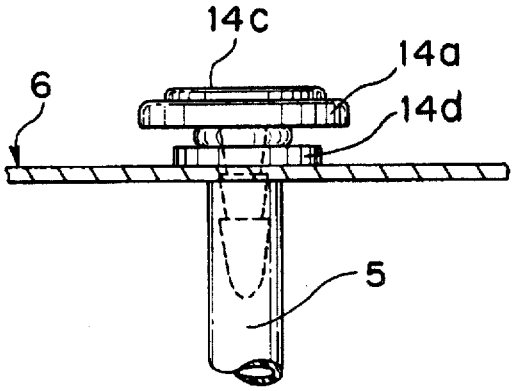
FIG. 23 is a side elevational view, partly in section, showing the fastener of FIG. 22 in the operative position on the end of a tubular lace.
Figure 24:
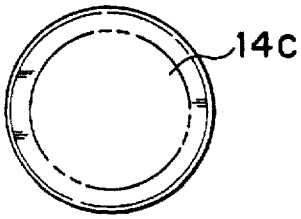
FIG. 24 is a top plan view of the fastener shown in FIG. 23.

Still another embodiment of a lacing fastener 14, preferably constructed of stiff or semi-rigid plastic material, is illustrated in FIGS. 22 to 24 and comprises a button 14*a* having an integral, barbed shank 14*b* depending therefrom. This is a knotless locking fastener for the terminal end of the tubular lacing 5, and presents a low profile terminus for the end of the lacing 5, as compared to a raised knot in the terminal end of the lacing. The manufacturer's logo 14*c* is carried on the top of the button 14*a*, and a plastic washer 14*d* is placed over the end portion of the tubular lacing 5. To install the fastener 14, the end portion of the tubular lacing 5 is pulled through the aperture 8' of the leather covering 6 and while being held in a stretched condition, the washer 14*d* is placed over the end portion of the lacing 5 into abutting relationship with the leather covering 6. The barbed shank 14*b* is then inserted into the tubular lacing 5. The tube 5 is then released and the washer 14*d* is pressed toward the button 14*a* by means of a suitable tool, such as, a pliers, snugly squeezing the wall of the tubular lace between the washer aperture and the barbed shank 14*b*.

From the above description it will be readily appreciated by those skilled in the art that the grooved foam rubber padding 3, 9 and 10 provides the glove with a "broken-in" feel when the glove is put on for the first time. The elastic memory of the polyurethane tubing 5 maintains the shape of the glove intact during repeated use, and cooperates with the grooved padding structure to substantially reduce ball rebound from the glove. The cooperation between the elements results in more caught balls by a user of the glove, and fewer missed balls due to rebound of balls from gloves during the process of catching a ball. The fasteners 12, 13 and 14 provide an improved appearance to the knotted end 7 of the lacing 5, preventing the knotted end from pulling through the aperture in the leather covering 6, while also providing a location for the manufacturer's logo; all of which results in an improved baseball glove.

While the grooved padding system and polyurethane tube lacing have been shown only for catcher's mitts and fielder's gloves, it is to be understood that these structures can be used for all types of baseball gloves in slightly modified form.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. A baseball glove having a thumb and forefinger portion having a longitudinal axial direction, and a little finger portion having a longitudinal axial direction, comprising a foam rubber padding positioned in the thumb and forefinger portion of the glove and the little finger portion of the glove, said foam rubber padding being a laminate structure having a base layer and at least one layer superimposed on the base layer, said base layer having a higher density than the superimposed layer to thereby provide a stiffness to the thumb and forefinger portion of the glove and to the little finger portion of the glove along the longitudinal axial direction thereof, grooves provided in the foam rubber padding in the thumb and forefinger portion of the glove, to thereby enhance flexibility of the thumb and forefinger portion of the glove, whereby pivoting of the thumb and forefinger portion of the glove toward the little finger portion of the glove is facilitated when catching the ball.

2. A baseball glove according to claim 1, wherein the grooves extend longitudinally and transversely in the superimposed layer.

3. A baseball glove according to claim 1, wherein a plurality of apertures are provided in the foam rubber padding, a leather covering enclosing the padding, eyelets provided in said leather covering, and plastic tube lacing having elastic memory extending through the holes in the padding and eyelets in the covering for holding the padding within the covering.

4. A baseball glove according to claim 3, wherein a knot tied at the terminal end portions of the plastic tube lacing and said plastic tube lacing crushed at said knot to provide improved securing of the terminal end portions of said plastic tube lacing to the leather covering.

5. A baseball glove according to claim 1, wherein a stiffener is provided in the padding positioned in the thumb and forefinger portion of the glove, said stiffener being positioned on the side of the base layer opposite from the superimposed layer to thereby enhance the stiffness of the thumb and forefinger portion of the glove in said longitudinal axial direction, and plural grooves in said stiffener extending in said longitudinal axial direction thereby limiting the stiffness of said stiffener in a lateral direction.

6. A baseball glove according to claim 1, wherein a stiffener is provided in the padding positioned in the little finger portion of the glove, said stiffener being positioned on the side of the base layer opposite from the superimposed layer, to thereby enhance the stiffness of the little finger portion of the glove in said longitudinal axial direction, and plural grooves in said stiffener extending in said longitudinal axial direction thereby limiting the stiffness of said stiffener in a lateral direction.

7. A baseball glove according to claim 2, wherein the longitudinally and transversely extending grooves extend at substantially right angles to each other.

8. A baseball glove according to claim 2, wherein the longitudinally and transversely extending grooves intersect each other forming longitudinal and lateral hinge axes in said superimposed layer.

9. A baseball glove according to claim 2, in which said longitudinally extending grooves are spaced above and extend substantially at right angles to said transversely extending grooves, and said grooves being V-shaped at angles in the range of 15°–45°.

10. A baseball glove having a thumb and forefinger portion having a longitudinal axial direction, and a little finger portion having a longitudinal axial direction, comprising a foam rubber padding positioned in the thumb and forefinger portion of the glove and the little finger portion of the glove, grooves provided in the foam rubber padding in the thumb and forefinger portion of the glove, to thereby enhance flexibility of the thumb and forefinger portion of the glove, whereby pivoting of the thumb and forefinger portion of the glove toward the little finger portion of the glove is facilitated when catching a ball, a plurality of apertures provided in the foam rubber padding, a leather covering enclosing the padding, eyelets provided in said leather covering, plastic tube lacing having elastic memory extending through the holes in the padding and eyelets in the covering for holding the padding within the covering, said lacing having terminal end portions, a knot tied at the terminal end portions of said lacing for securing the terminal end portions of said lacing to the leather covering, a disc mounted on the plastic tube lacing at the knot, and advertising indicia on the face of said disc.

11. A baseball glove having a thumb and forefinger portion having a longitudinal axial direction, and a little finger portion having a longitudinal axial direction, comprising a foam rubber padding positioned in the thumb and forefinger portion of the glove and the little finger portion of the glove, grooves provided in the foam rubber padding in the thumb and forefinger portion of the glove, to thereby enhance flexibility of the thumb and forefinger portion of the glove, whereby pivoting of the thumb and forefinger portion of the glove toward the little finger portion of the glove is facilitated when catching a ball, a plurality of apertures provided in the foam rubber padding, a leather covering enclosing the padding, eyelets provided in said leather covering, plastic tube lacing having elastic memory extending through the holes in the padding and eyelets in the covering for holding the padding within the covering, said lacing having terminal end portions, a knot tied at the terminal end portions of said lacing for securing the terminal end portions of said lacing to the leather covering, a disc, a central aperture provided in said disc, said plastic tube lacing extending through said aperture, a said knot provided on the lacing abutting the face of the disc, a closure hingedly connected to said disc, said closure having a planar top wall and a depending skirt portion, a plurality of fingers integral with the skirt portion adapted to snap against the opposite face of the disc, whereby the knot is covered by the closure, and advertising indicia on the upper surface of the closure top wall.

12. A baseball glove having a thumb and forefinger portion having a longitudinal axial direction, and a little finger portion having a longitudinal axial direction, comprising a foam rubber padding positioned in the thumb and forefinger portion of the glove and the little finger portion of the glove, grooves provided in the foam rubber padding in the thumb and forefinger portion of the glove, to thereby enhance flexibility of the thumb and forefinger portion of the glove, whereby pivoting of the thumb and forefinger portion of the glove toward the little finger portion of the glove is facilitated when catching a ball, a plurality of apertures provided in the foam rubber padding, a leather covering enclosing the padding, eyelets provided in said leather covering, plastic tube lacing having elastic memory extending through the holes in the padding and eyelets in the covering for holding the padding within the covering, said lacing having terminal end portions, a washer extending around the terminal end portion of said plastic tube lacing and abutting said leather covering, a barbed shank extending axially into the open end of the plastic tube lacing for securing the terminal end portions of said lacing to the leather covering, and a button on the end of the barbed shank exteriorly of the tube lacing, and advertising indicia on the top surface of said button.

* * * * *